United States Patent [19]

Weiss et al.

[11] Patent Number: 4,555,819

[45] Date of Patent: Dec. 3, 1985

[54] HOLDER FOR CLEANING AND/OR COLORANT PRODUCTS INTENDED TO BE HOOKED FROM THE EDGE OF A WC BOWL

[75] Inventors: Richard Weiss, Chartres; Hubert Delagneau, Mainvilliers, both of France

[73] Assignee: Reckitt & Colman S.A., Massy, France

[21] Appl. No.: 606,825

[22] PCT Filed: Aug. 17, 1983

[86] PCT No.: PCT/FR83/00169

§ 371 Date: Apr. 20, 1984

§ 102(e) Date: Apr. 20, 1984

[87] PCT Pub. No.: WO84/00990

PCT Pub. Date: Mar. 15, 1984

[30] Foreign Application Priority Data

Aug. 26, 1982 [FR] France ..... 82 14652

[51] Int. Cl.[4] ..... A47C 19/00

[52] U.S. Cl. ..... 4/223; 422/266; 422/263; 422/277

[58] Field of Search ..... 422/255, 266, 263, 264, 422/276, 277, 278, 301; 4/227–231, 223, 224

[56] References Cited

U.S. PATENT DOCUMENTS 4,281,421 8/1981 Nyguist et al. ..... 422/264
4,490,861 1/1985 Dolan ..... 4/227

FOREIGN PATENT DOCUMENTS 1930773 1/1970 Fed. Rep. of Germany ..... 4/228
2424374 11/1979 France .
379553 9/1932 United Kingdom .

*Primary Examiner*—Arnold Turk
*Assistant Examiner*—Titus B. Ledbetter, Jr.
*Attorney, Agent, or Firm*—Karl W. Flocks; Sheridan Neimark; A. Fred Starobin

[57] ABSTRACT

A holder comprising a sealed container provided to receive a water-soluble active, solid composition and to protect it against the direct erosion by water susceptible to penetrate in the container. The holder including a basin having a predetermined volume arranged at the upper portion of said container and having at least one hole in the bottom thereof, a discharge device for discharging in a water closet (WC) bowl and consisting of two siphon-type systems and of an appropriate hooking system to hook the holder under an edge of a WC bowl.

2 Claims, 9 Drawing Figures

FIG. 6
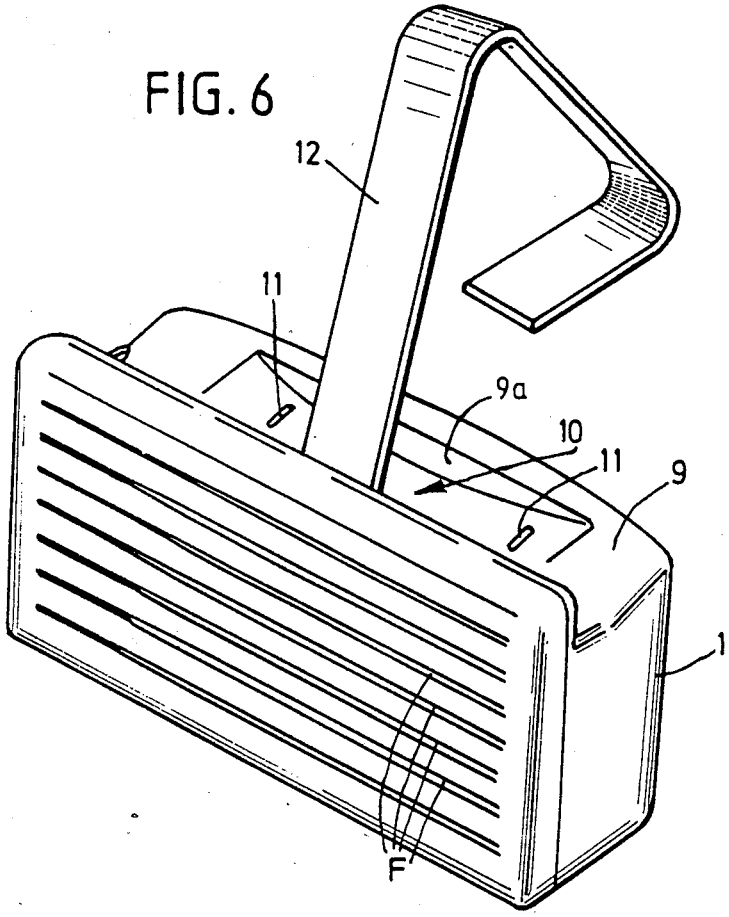
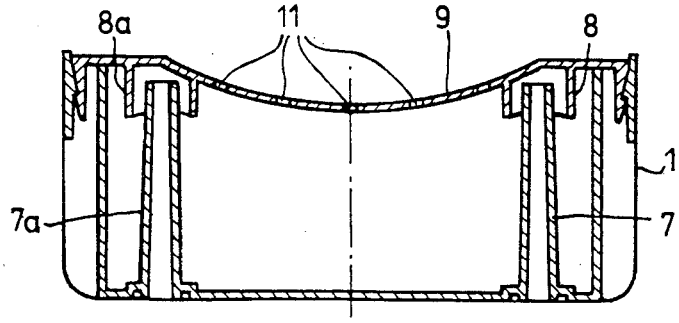
FIG. 7

HOLDER FOR CLEANING AND/OR COLORANT PRODUCTS INTENDED TO BE HOOKED FROM THE EDGE OF A WC BOWL

The present invention is concerned with an improved support for cleansing and/or colourant products, for hanging on the rim of a WC-bowl.

A large number of devices ar already known which are designed to receive cleansing and/or deodorising products with a view to maintaining WC-bowls in a state of cleanliness and/or disinfection or for the deodorisation of the latter.

In a number of cases the products used to this end contain compounds and/or colourants which are soluble in water (in general blues or greens), intended to react with and/or to colour the water remaining in the bowl after each flushing operation.

Known devices may be classified into two main categories, according to whether the product or composition used, which is generally presented in the form of a solid block, is immersed in the water between two flushing operations or on the contrary is located in the atmosphere and consequently exposed between these operations.

The principles according to which known devices have been designed are briefly summarised hereafter schematically with reference to FIGS. 1 to 5 of the appended drawings.

The following fall into the category of immersed blocks:

1. Those (see FIG. 1) constituted by a simple generally perforated receiver or basket (1) for containing the block of the composition under consideration and provided with a handle or other means of hanging (2) on the rim of a WC-bowl;

2. Those (see FIG. 2) also comprising a receiver (1) divided into two compartments, the first (1*a*) designed to contain the composition or the block under consideration, and the second (1*b*) provided with siphon means (1*c*), the whole being adapted to be suspended or hung on the rim of a WC-bowl by the intermediary of hanging means (2) (see German Pat. No. 1903773—Potrafke and French Pat. No. 1117332—Roussey);

3. Those (see FIG. 3) having the receptacle (1) containing the block of composition under consideration (1*a*), in which the said receptacle (1) is provided with siphon means (1*c*).

The whole is provided with its hanging means (2) for the rim of a WC-bowl (see French Pat. No. 8109221—L'Oreal and British Pat. No. 379553—Brain).

The following are in the category of exposed blocks:

1. Those (see FIG. 4) comprising a block (1*a*) with its support means or basket (3) directly connected to the hanging means (2) (See French Pat. No. 2170341—Reckitt) and 2. Those (see FIG. 5) comprising a retaining chamber (1) provided with a mesh support (3) for the composition under consideration (1*a*) and, below the said mesh, a siphon device (1*c*) the whole being provided in well known fashion with hanging means (2) (see for example French Pat. No. 2424374—Globol).

These devices present a certain number of major disadvantages namely:

(A) For immersed blocks:

One of the principal functions of the blocks that are suspended on the rim of WC-bowls is to contribute to the deodorisation and disinfecting of the WC-bowl.

This function may be realised in two ways either separately or simultaneously, namely, either by transfer of an amount of the active product into the water remaining in the bowl or by evaporation of this active product from the block of the composition under consideration. It may be appreciated that when such a block is immersed in water such evaporation is rendered virtually impossible, as a result the deodorisation and/or disinfection observed in such case is very mediocre.

A second inconvenience of immersed blocks occurs with blocks of coloured compositions: in this case it has indeed been established that each time the action is flushed and after the rinsing water has flowed from the housing-support in which the coloured block is situated, an accumulation of coloured drain marks extending along the side of the WC-bowl is produced. The drain marking is more or less intense depending upon the ease with which erosion of the colourant block occurs. Furthermore the colour of the drain marks formed gradually increases in concentration with time. In this way a coloured trail or mark is formed, along the lateral wall of the WC-bowl and beneath the colourant block, which is undesirable and apart from all else is difficult to eliminate when dripping has gone on for some time. Attempts to remedy these disadvantages have been tried by providing the chamber containing the block of active composition with a siphon, as in the case of the L'Oreal patent application mentioned above, or by providing a separate retaining chamber provided with a siphon device, as in the case of the Potrafke patent previously cited.

However, if these known devices allow for partial resolution of the problem posed by the formation of trains of colourant on the walls of the WC, they are not entirely satisfactory in all cases. Indeed, the diversity of shape, the plurality of WC-bowl rim profiles, variability of the discharge and force of the water admitted to a bowl on each individual flush are such that, in use, these devices can take up ineffective positions, often associated with the difficulty of maintaining them horizontal, which precludes proper functioning. Spillages and drops of concentrated active product solution occur with accompanying formation of stains on the walls of the WC-bowl, notably when the block of active composition used is especially designed for colouring the water. Strictly speaking one could totally or partially remedy this disadvantage for example by considerably increasing the volume of the retention chamber without increasing the quantity of active product. Such a solution is however not realisable in practice, insofar as the volume of WC-bowl disposable for use by this type of product is strictly limited; for obvious aesthetic reasons and technical reasons which have reference to normal functioning related to the level of water remaining in the WC-bowl and necessary for priming the siphon of the latter.

(B) For exposed blocks:

When these devices do not have a retention chamber, they are obviously quite inadequate for receiving coloured blocks. When they are provided with a retention chamber situated below the volume containing the block of active composition and separated therefrom by a grill for supporting such block, such as for example the device described in the Globol patent mentioned above, these devices also have major disadvantages: indeed mechanical erosion of the blocks of active composition, which may be more or less well protected against the action of the outflow of water on flushing, takes place inevitably. This erosion involves the formation of solid particles tending totally or partially to obstruct the grill system and/or the emptying of water from the device in question, thus rendering them partially or totally inoperative.

Other disadvantages result from the fact that these exposed devices do not admit of obtaining constant rates of wear and again constant dosages of the active product into the water in the WC-bowl, these rates being necessarily dependent not only on the type of bowl and the flow of the WC but equally on the position adopted by these devices in the bowl. Thus in practice theoretical use of the active product cannot be guaranteed.

Accordingly, the present invention purports to obviate all these disadvantages and provides an improved support device, for active products, designed to be hung from the rim of a WC-bowl permitting dosing the water remaining at the bottom of the bowl after flushing with a quantity of an active product which is soluble or emulsifiable in the water.

The device in accordance with the invention is essentially characterised by the fact that it comprises:

an enclosure constructed for lodging at least one block and for containing a predetermined volume of a concentrated aqueous solution of treatement product(s) said block being at least partially in contact with said solution;

means to protect said block against direct erosion thereof by the flushing of the WC;

means to admit to said container a predetermined volume of flushing water for diluting the said concentrated aqueous treatment product(s), the excess of said flushing water being directly conducted into said WC-bowl; and, a deferred action discharge device for directing a predetermined volume of diluted liquid medium into the WC-bowl.

Figure 1:
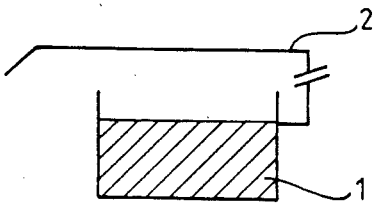
PRIOR ART FIG. 1
FIGS. 1–5 are schematics of prior art immersed block apparatus.
Figure 2:
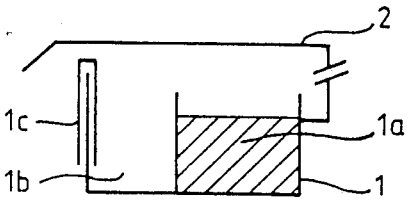
PRIOR ART FIG. 2
Figure 3:
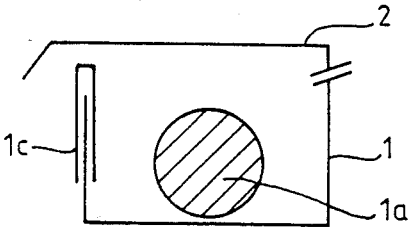
PRIOR ART FIG. 3
Figure 4:
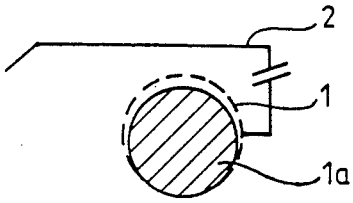
PRIOR ART FIG. 4
Figure 5:
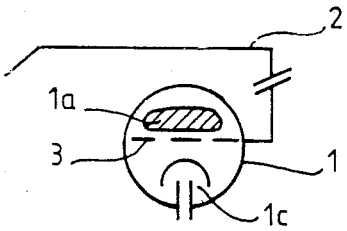
PRIOR ART FIG. 5
Figure 8:
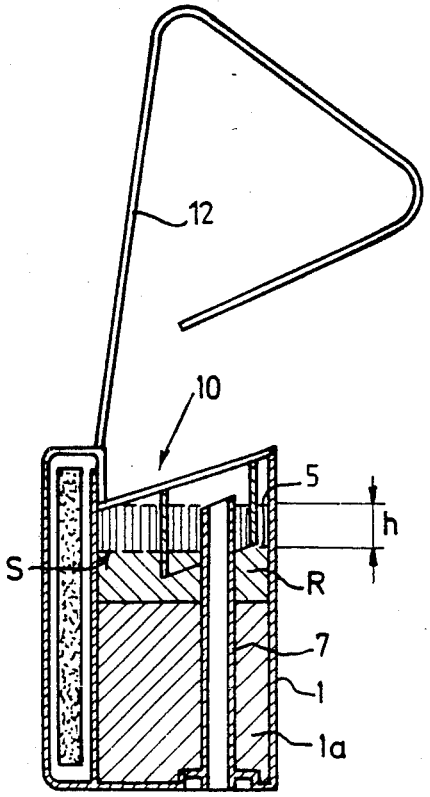

Characteristics and advantages of the instant invention will emerge more clearly from the following description which has reference to FIGS. 6 to 9 of the annexed drawings, in which:

FIG. 6 is a perspective view of an embodiment of a device in accordance with the invention;

FIG. 7 is a side view of a longitudinal section of such a device;

FIG. 8 is a side view of a transverse section; and

Figure 9:
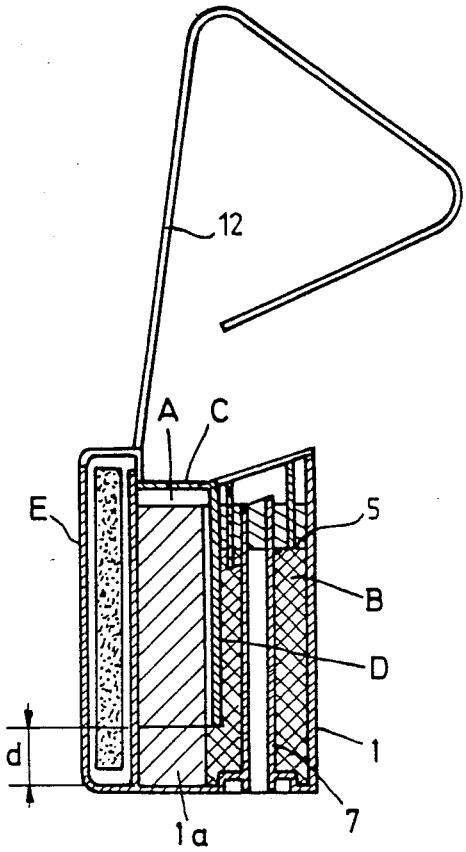

FIG. 9 is a view corresponding with FIG. 8 but of a modified embodiment.

Referring to the drawings; the improved support device in accordance with the present invention comprises a water-tight reservoir (1) for receiving a water-soluble or emulsifiable active composition of known type that has disinfectant and/or deodorant and/or colourant effect (1*a*).

Most frequently such composition is in the form of a solid block.

In one embodiment illustrated at FIG. 8, a reservoir (1) constitutes a single cavity in which a block (1*a*) is lodged directly. In accordance with another variant such as that illustrated at FIG. 9, the reservoir (1) is divided into two compartments (A and B) by an impervious partition (C) of square shape forming a bell and of which the vertical skirt (D) is spaced a certain distance (d) from the bottom of the reservoir (1) to permit free circulation of dissolving water as is apparent hereinafter in the description of the functioning of the device.

Two opposed tubules (7–7*a*) are disposed interior of the reservoir (1) along the longitudinal axis thereof and advantageously, in the neighbourhood of the lateral walls orthogonal to this axis. The lower extremity of each tubule passes through the bottom of the reservoir (1) to the exterior thereof to constitute a discharge orifice whereas each of their upper extremities is covered with a bell (8–8*a*) formed on the lower face of a concave cover (9) having raised borders (such as 9*a*) to form a cavity or second reservoir (10) of predetermined volume the bottom of which having at least one or several metering orifices (such as 11). The combination of the tubule (7) and the bell (8) thus constituting a siphon arrangement.

The above assembly is provided with hanging means of any appropriate known type for fixing it and maintaining it under the rim of a WC-bowl. Advantageously one such system can be formed for example from one or several handles (such as 12).

The functioning of the above described device is as follows:

The device is mounted under the rim of a WC-bowl, reservoir (1) carrying its solid composition (1*a*) and will, after a few initial operations of the flushing action, contain a reservoir of concentrated solution of the active product (R) of which the upper surface (5) is substantially level with the lower extremity of the skirt of the bell (8–8*a*). Whereupon water flow resulting from the flushing action causes the second reservoir (10) to be filled with a pre-determined corresponding volume of water, the excess emptying itself directly into the WC-bowl by overflowing without entering into contact with the block or the solution of active product which is in the reservoir (1). Thus all stains or trails stemming from scavenging from a coloured block by the current of water from a flush are avoided. When the reservoir (10) empties through the orifice or orifices (such as 11), the upper level of the solution (R) rises through height (h) and the volume of water thus added corresponds to that of the volume of the cavity (10). This predetermined volume serves to dilute the concentrated solution (R) both to a known extent and in uniform fashion from one flush to another. Also it constitutes the priming volume of the siphon system constituted by tubules (7–7*a*) and their bells (8–8*a*). These siphon systems constitute the delayed action discharge means. Indeed as is well known a siphon only works when it is primed. Between the moment when the flushing water is admitted and the moment when the siphon empties, it is necessary to wait for priming of the siphon. Emptying takes a certain amount of time. But once primed, the siphon systems ensure that a solution of active product(s) with the predetermined degree of dilution empties itself out through the tubules (7–7*a*) directly into the WC-bowl until the liquid level in the reservoir (1) falls to level S which corresponds with breaking the siphon. Equally in this case no inopportune dripping can take place during the period of non-use between flushes. On the other hand, by virtue of the position and location of the siphon systems, the result is that in conditions where the arrangement of a device in accordance with the invention is not horizontal, at least one of the two siphons can function, thus avoiding loss of concentrated active product(s) solution (R) directly into the WC-bowl and the eventual stains or trails of colourant which would result from such spillages.

It should be noted, that the device according to the invention allows the delivery, after each flushing action, of a predetermined quantity of active substance irrespective of the mechanical force of the flushing water and/or the position of the device on the wall of the WC-bowl and at the same time avoids runs and drips of concentrated active product solution between flushes on the said wall of the WC-bowl.

In order to ensure delivery of a still more practically constant quantity of substance during the life of the block of active composition in use, reservoir (1) may have a chamber (A) especially designed to receive the said active composition, as illustrated in the embodiment of FIG. 9. This chamber is formed by walls (C–D) forming a bell and it is only in communication with chamber (B) through its lower part. This arrangement thus allows control of the surface contact between the water and the active composition during the whole of its life, whilst both preserving the constancy of the volume of concentrated solution and its degree of dilution by the flow of flushing water, dissolution of the active product and the disappearance of a certain volume of solid composition does not affect the volume of the said concentrated solution by virtue of the separator (D) except of course, substantially at the end of its use, when the block (1*a*) occupies the volume below the skirt (D). The embodiment illustrated at FIG. 8 does not permit such maintenance of constant volume by reason of the variation of the latter as a function of solids composition volume totally immersed which would disappear gradually as it dissolves.

It is to be observed additionally that the device which is described can to advantage be provided with a separate chamber (E) provided with appropriate apertures (such as the slits F), this chamber being designed to receive a substrate (insoluble) impregnated with volatile material(s) or a solid active composition (insoluble) for treatment of the ambient air.

The foregoing description of the present invention is intended to be explanatory and not limitative and all useful modifications are included without departing from the general sense.

We claim:

1. A support device for solid treatment products which are dispersible or soluble in water and used in block form, for positioning under the rim of a water closet (WC) bowl comprising:

an elongated enclosure, having a bottom and a longitudinal axis, containing at least one solid treatment block; means to protect said block against direct erosion thereof by flow of water from a WC bowl, said protecting means being a cover fitted to said enclosure;

a deferred action discharge means for directing a predetermined volume of diluted liquid medium into a WC bowl, said deferred action discharge means including at least two siphon systems longitudinally spaced on opposed ends of said enclosure;

a vertical wall integral with said cover extending across the longitudinal axis of said enclosure and extending towards but spaced from the bottom of said enclosure into two compartments containing in one of said compartments said siphon systems and in the other of said compartments, said at least one block, said other of said compartments having its upper end closed by said cover;

means for admitting into said enclosure a predetermined volume of flushing water, said admitting means being positioned in said cover over said compartment containing said siphon systems, and including at least one bowl means for retaining a fraction of the flushing water with the remainder of the flushing water being directed into a WC bowl, and at least one metering orifice formed in said bowl means; and means to hold said enclosure under the rim of a WC bowl.

2. The device according to claim 1, further characterized by a separate chamber (E) provided with apertures, said separate chamber being designated to receive a material comprising volatile substances for treatment of the ambient air.

* * * * *